US006203152B1

(12) United States Patent
Boleda et al.

(10) Patent No.: US 6,203,152 B1
(45) Date of Patent: Mar. 20, 2001

(54) INK AEROSOL CONTROL FOR LARGE FORMAT PRINTER

(75) Inventors: Miquel Boleda, Barcelona (ES); Robert R Giles, Escondido, CA (US); Paul David Gast, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/397,610

(22) Filed: Sep. 16, 1999

(51) Int. Cl.[7] ..... B41J 29/377
(52) U.S. Cl. ..... 347/102; 347/18
(58) Field of Search ..... 346/25; 347/18, 347/102, 223, 83

(56) References Cited

U.S. PATENT DOCUMENTS 5,296,873 * 3/1994 Russel et al. ..... 346/25
5,406,316 * 4/1995 Schwiebert et al. ..... 347/18

* cited by examiner

*Primary Examiner*—N. Le
*Assistant Examiner*—Anh T. N. Vo

(57) ABSTRACT

An inkjet printing device comprises a platen on which a printing zone is defined, a carriage, onto which at least a printhead is mounted, slidable along the printing zone near the platen, a service station, located in a service zone separated from the printing zone, a housing protecting and enclosing the printing zone and the servicing zone, and a device, for example a fan, for producing an air flow within the housing. A substantially constant air path is defined within the housing of the device through which the air flow is allowed to pass during its operation. A method for reducing ink aerosol in such a device, during its operation, comprises the following steps: producing an air flow within the housing, and forcing the air flow to pass through a substantially constant air path defined within the housing.

12 Claims, 6 Drawing Sheets

INK AEROSOL CONTROL FOR LARGE FORMAT PRINTER

BACKGROUND OF THE INVENTION

1. Field of the Invention

This invention relates, in general, to the field of ink jet printing mechanisms and, more specifically, to systems to control the build up of ink aerosol, that is, the build up of ink droplets in suspension, which are produced during operation in large format ink jet printers, plotters and the like.

2. Description of the Related Art

An ink jet device is a printing device without impact that forms characters and other images by ejecting ink drops in a controllable way from a printhead. The ink jet printing mechanisms may be used in different devices such as printers, plotters, facsimiles, copiers and the like. For the sake of convenience, in what follows reference will be made only to large format ink jet printers to illustrate the concepts of the present invention.

The printhead of a machine of the kind mentioned ejects ink through multiple nozzles in the form of minuscule drops which "fly" for a small space and strike a printing support. Different nozzles are used for different colors. Ink jet printers usually print within a range of 180 to 2400 or more dots per inch. The ink drops are dried upon the printing support soon after being deposited to form the desired printed images.

There are several types of ink jet printheads including, for example, thermal printheads and piezoelectric printheads. By way of example, in a thermal ink jet printhead the ink drops are ejected from individual nozzles by localized heating. Each of the nozzles has a small heating element. An electric current is made to pass through the element to heat it. This causes a tiny volume of ink to be heated and vaporized instantaneously by the heating element. Upon being vaporized, the ink is ejected through the nozzle. An exciter circuit is connected to individual heating elements to supply the energy impulses and, in this manner, to deposit in a controlled way ink drops from associated individual nozzles. These exciter circuits respond to character generators and other imaging circuits to activate selected nozzles of the printhead in order to form the desired images on the printing support.

As those skilled in the art know, during the operation of an ink jet printer of the mentioned class, the machine generates an ink fog constituted by very small ink particles (of a size usually less than 5 microns) that are stopped in their flight from the printhead to the printing support (within 1 mm from the printhead) and remain in suspension in the air. This fog of ink particles, also called "ink aerosol", builds up within the printer and is associated with undesirable deposition of said ink particles on critical surfaces of the printer (optical sensors, bearing surfaces, electronic assemblies, etc.), which may lead to failures, for example in the head position codifying system due to the presence of ink deposits on the encoder strip.

Moreover, the deposit of ink particles from the said aerosol upon surfaces such as the machine's windows, covers and doors, as well as upon other surfaces that may transfer ink onto the hands of the user or even onto the walls and floor of the room in which the machine is situated, may not only be annoying when handling the machine, but also the dissipation of said deposit into the atmosphere may be harmful from the environmental point of view.

This problem is aggravated in the case of large format, high performance machines (provided with bigger print heads having a great number of nozzles), in which the amount of ink used throughout the machine's useful life generates a considerable amount of aerosol.

In the document EP-0705700 an ink jet printing mechanism is disclosed, which includes: a plurality of ink jet printheads each one in a controlled way ejecting multiple ink droplets; a carriage which transports the printhead through a printing zone to a service station where at least one of the nozzles ejects in a controlled way ink droplets during maintenance mode; a collecting container (spittoon) situated in the service station to collect the ejected ink droplets; and multiple channels situated adjoining the container, with different channels receiving ink droplets ejected from nozzles of two different printheads and guiding said ink droplets ejected from the different printheads to reservoir of the container in order to avoid the mixing of different inks in said channels.

In no part of the above document reference is made to the control or elimination of the aerosol formed by ink droplets in the printing zone during the machine's operation. The document tries to address the problem that arises from the generation of droplets in suspension solely in the area of the service station of the said printhead nozzles. Nor it is indicated that said control is carried out by means of a flow of cleaning air.

In document EP-0568256 there is disclosed a use of an air flow and a filter for collecting and trapping the ink particles that are maintained in suspension during the operation of an ink jet printer. However, this known system is not usable except in low performance ink jet printers and its use is not satisfactory in the case of high performance, large format ink jet printers or plotters, with large printheads of the type mentioned hereinbefore, as with this system the ink droplets in suspension are collected, exclusively, in the machine's printing zone.

In a HP DesignJet 2000 CP Series printer, a fan is installed at the service station end of the printer, which is permanently running when the printer is operating, to generate a constant air flow in the service station area. However, no constant air path is available either in the print zone or in the service station zone. In fact, since the air flow is not designed to clean the print zone, the carriage is a first obstacle to the air path in the printing zone, i. e. the air path is varying depending on the actual position of the carriage.

Furthermore, the service station itself is a second obstacle to the air path in the service zone; in fact the service station, when it is moved in its servicing position, is substantially reducing the air flow in the service zone.

Finally, other methods already known in the art consist of modifying the formulation of the inks used or the design of the printheads, or in generating electrostatic fields in the printing zone to direct the ink particles in suspension towards the print medium. The applicant considers that all these have shortcomings from the economic point of view and due to their technical complexity, and/or they have a more negative impact on the design of the machine than the system in accordance with the invention.

SUMMARY OF THE INVENTION

An object of the invention, therefore, is to provide an improved system for controlling the build up of ink aerosol generated in a printer or plotter that overcomes the shortcomings of the known systems.

In accordance with the invention, not only is the ink aerosol eliminated that is generated in the printing zone and/or in the service station of the print heads, but also the entire interior of the machine is kept clean more economically and effectively than with the systems of the foregoing technique.

Moreover, the system in accordance with the invention not only controls the generation of said ink aerosol throughout the interior of the machine but also allows more suitable temperature values to be maintained for the internal components of the same (motors, electronic circuits, printheads, etc.).

These and other objectives and advantages are achieved because, according to the invention, a design is provided of the interior of the printer which, in operating conditions of the same, allows significant substantially closed obstacle-free space to be obtained, making it possible to achieve an air path for a forced flow of cleaning air intended to entrain the droplets of ink in suspension forming said aerosol, which flow originates in at least one air inlet of the printer, sweeping the areas of the latter in which the ink aerosol originates, i.e., said printing zone and said service zone of the printer head, and is released into the atmosphere through an outlet provided in one of the ends of the printer frame.

Here the expression "air path" means a space, preferably substantially straight, having a certain minimum section which is kept free from obstacles into which the air is allowed to flow at a substantially constant speed.

In one preferred embodiment of the invention, the entry of air into the printer is carried out, in part, through an additional inlet opening, provided at the end of said printer frame opposite to the one in which said air outlet is provided, and in part through said at least one air inlet to said printer.

According to yet another aspect of the invention, said forced flow of cleaning air is created by suction means provided in or near the said outlet opening.

According to yet another aspect of the invention, said flow of cleaning air generated by said suction means, is a quiet flow with a relatively high flow rate.

Also according to the invention, in said outlet opening of said flow of cleaning air, filtration means are provided for retaining the particles entrained in it, before being released into the atmosphere.

According to yet another aspect of the invention, said suction means are comprised by a fan which sucks air into the interior of the printer by said at least one inlet and releases it into the atmosphere through said outlet opening.

Finally, the invention contemplates the possibility of making the flow rate of the flow of cleaning air vary depending on the operating conditions of the machine.

DESCRIPTION OF THE INVENTION

Figure 1:
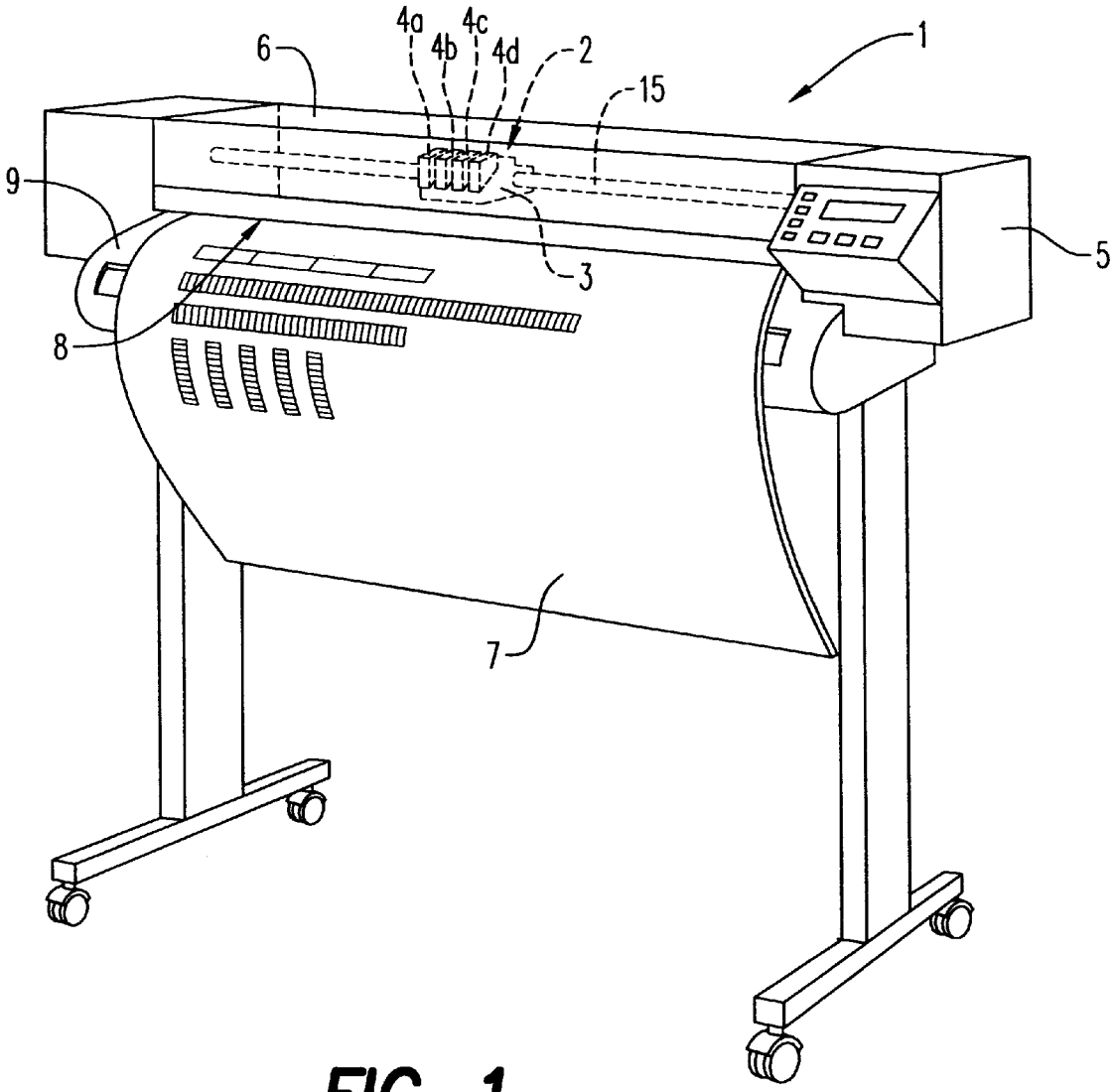
FIG. 1 is a perspective view of a large format ink jet printer that incorporates the present invention.

FIG. 1 shows an ink jet printer 1, constructed in accordance with this invention. In this case a large format, high performance graphics printer (plotter) is illustrated. The printer 1 includes a supporting platen (not shown), a printhead unit 2 which moves back and forth through the print zone and a service station (see FIG. 7, reference 70) located at one end 5 of the printer 1. The platen is designed to hold a printing media 7 which moves upon it during a printing operation. A feed mechanism for the media (not shown) comprising, for example, conventional friction rollers (e.g. main drive roller, pinch wheels and/or overdrive wheels), may be used to feed the media 7 through the printing mechanism, along a feed path of the same and out of the printer through an opening 8 defined between the lower edge of a cover 6 and a front platen 9.

The printer 1 has a predefined print zone (hidden in FIG. 1 by a swingable cover 6) which coincides, at least partly, with the feed path of the media in such a way that the latter is fed through the printing zone. An illustrative printing zone is defined as an area within which each of the multiple nozzles of the printheads of the printhead unit 2 may print throughout the entire width of the media.

The unit 2 that moves back and forth includes a carriage 3 mounted in such a way that it may slide on at least a fixed guide rod 15 so as to move bidirectionally along the platen. In the illustrated embodiment, the carriage 3 is designed to traverse the width of the platen, thus completely crossing the printing zone, and also to move occasionally to a service station 70 (FIG. 7), outside the printing zone. The unit 2 includes a driving sub-unit (not shown) which is connected mechanically to pull the carriage 3 in one direction or another along said, at least one rod 15. The print unit 2 is described in this specification solely for the purpose of explanation and its construction is well known in the art. Alternatively, other types of configurations may be used of the carriage assembly 3 that moves back and forth.

A typical driving sub-unit includes a wire or strip fixed to the carriage 3 and wound around opposing pulleys, and a motor (for example a stepping motor) connected to drive one of the pulleys. A rotating or linear encoder is often connected to the motor's drive shaft to monitor the increase in rotation of the shaft and supply feedback data to be used in the positioning and control of the carriage 3, although there are some printers which do not have an encoder.

The carriage 3 herein supports and carries one or more print cartridges or printheads. In the present case four printheads 4*a*, 4*b*, 4*c* and 4*d* are employed which preferably take the form of replaceable and disposable printheads. The printheads 4*a* to 4*d* are mounted on the carriage 3 in such a way that their nozzle sections are adjacent to the supporting platen, but separated from it, so as to allow the media to pass between them. The carriage 3 moves the printheads in one direction or another through the printing zone along the scanning axis. In the embodiment illustrated, the carriage 3 carries multicolor printheads, each one of one color, for example cyan, magenta, yellow and black. The ink supply tubing (not shown) to the carriage mounted printheads and the carriage itself are never in line. Air path is over said carriage 3 mainly in the tube guide, or below the tubing when the tubing make a bend. There is always available a path clear from obstacles for the air flow within the printer, closed between the platen and the cover 6 of the printer.

Figure 2:
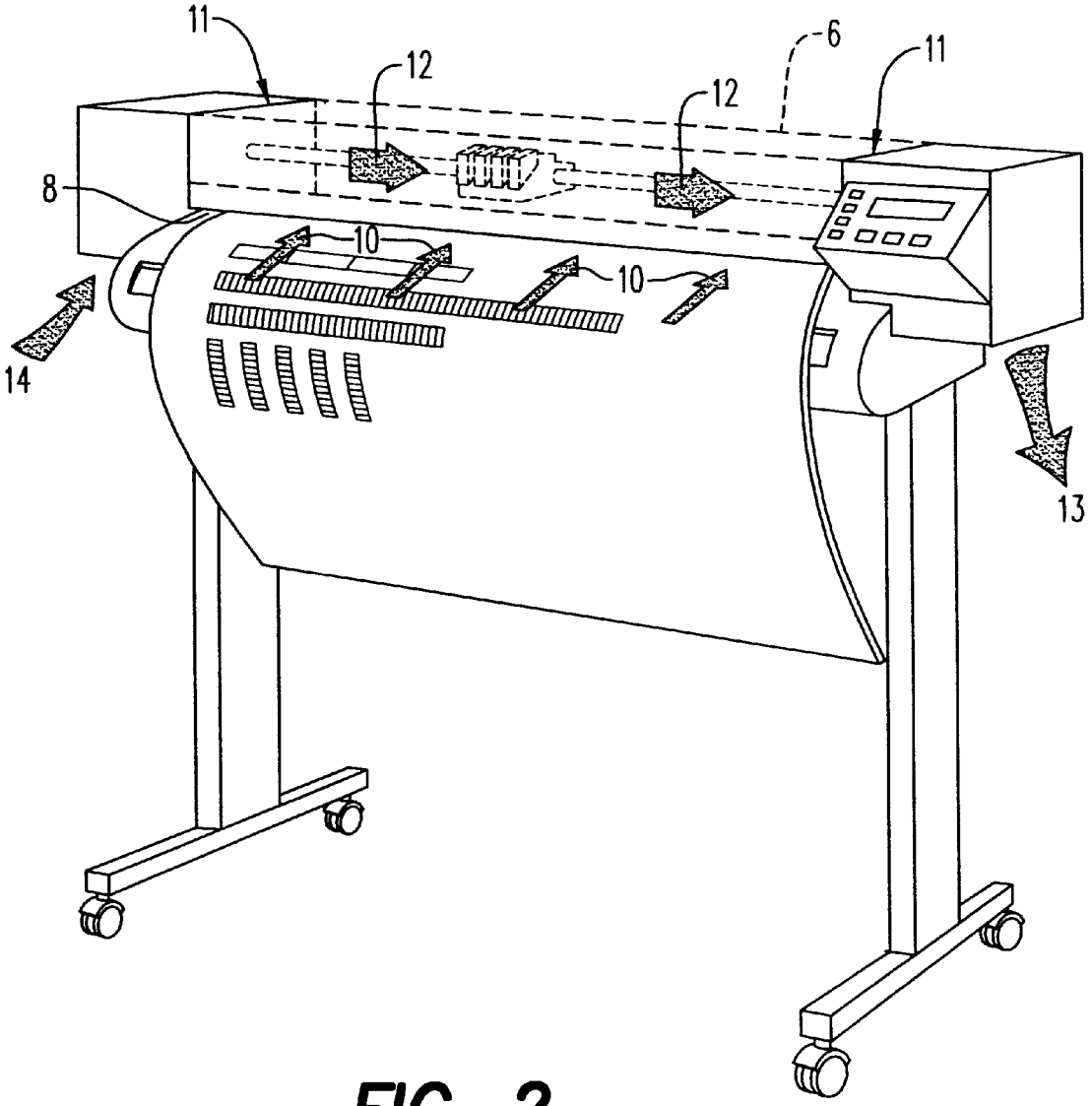
FIG. 2 is a perspective view like FIG. 1, which illustrates the circulation of cleaning air.

Making reference now to FIG. 2, therein, by means of dark arrows, the different locations are illustrated for the entry of air into the printer, as well as the pathway of the air flow through the interior of the printer and its evacuation into the atmosphere through a first end of the same. The above mentioned minimum section of this air path substantially free from obstacles is calculated based on the following formula:

$$A=V/ct$$

where A is the minimum section along the air path in the printing zone, c is the minimum speed allowed inside the printing zone, t is the time for an air renewal of the inside of the printer, and V is the volume of the inside of the printer.

As can be seen in FIG. 2, the air is sucked into the interior of the machine through various openings and slits inherent to its construction, such as the front slot 8 for passage of the media (arrows 10), the slits which may possibly exist between the swingable cover 6 in closed condition and the fixed frame of the printer (arrows 11) and a rear opening for the media (not shown). The air which thus enters into the printer, while it is operating, constitutes a quiet flow of air, with large flow rate (arrows 12) which runs throughout the entire interior of the machine, entraining with it the ink aerosol that is generated. Then as shown in FIG. 3, the flow rate (arrow 15) passes through a servicing zone 40 within enclosure 5, and finally, said flow of air is evacuated outside the machine through an outlet provided for the purpose in the lower part of a first end of the same, according to arrow 13.

Figure 3:
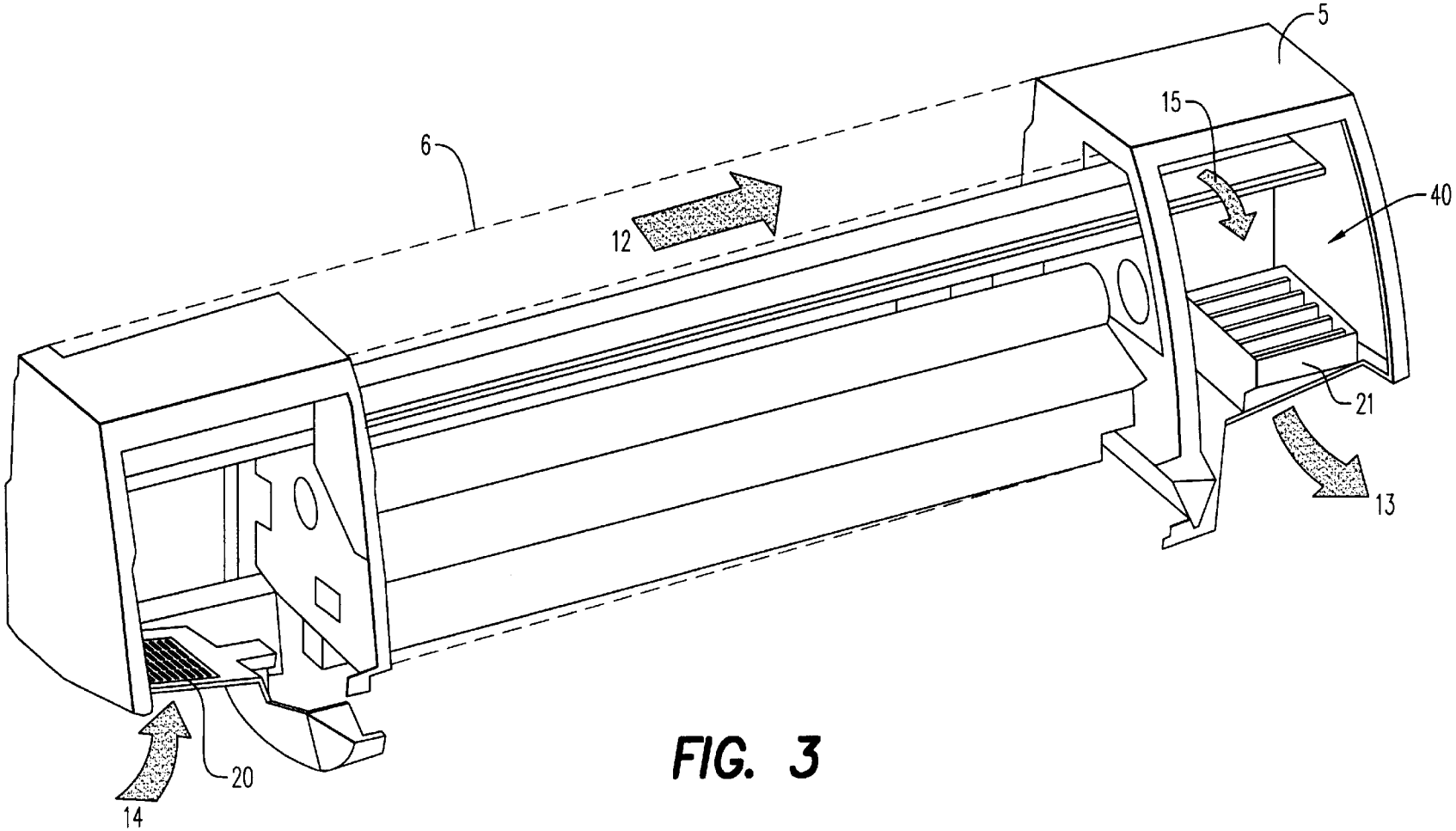
FIG. 3 is a perspective view of the frame of the printer of FIG. 1, with parts withdrawn.
Figure 7:
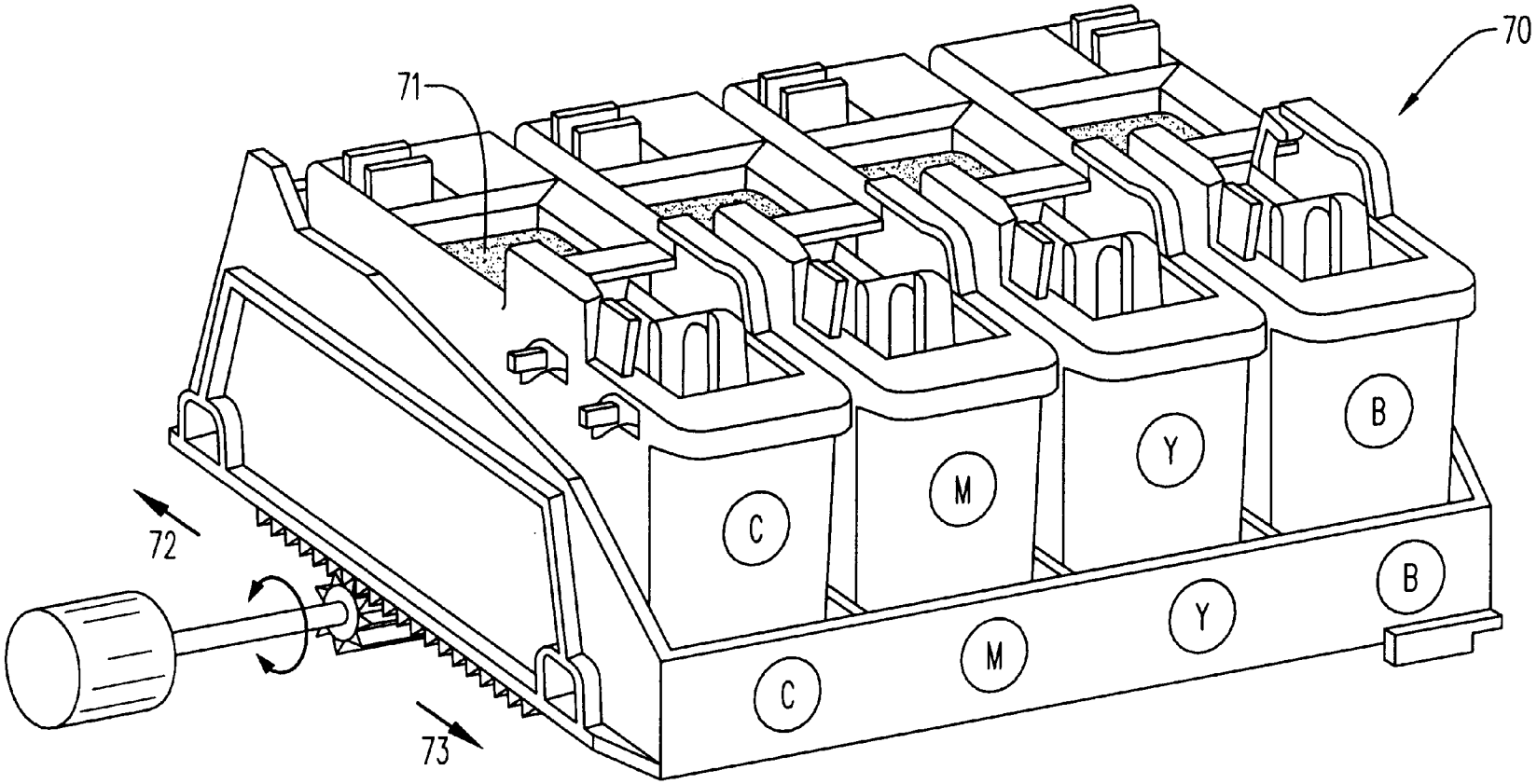
FIG. 7 is the perspective view of the service station, withdrawn from the printer in the view of FIG. 3.

For sake of simplicity, in the view of FIG. 3 the service station 70, shown alone in FIG. 7, has been withdraw from the servicing zone 40. These skilled in the art will appreciate that service station 70 fits into the service station zone 40, over the suction unit 21.

In a preferred embodiment of the invention, there can be provided an additional opening 20 (see FIG. 3) for entry of air in a second end of the printer, opposite to said first end through which the air is made to issue in 13. In this case, air would also enter into the machine according to arrow 14 (see FIG. 2).

Continuing with the reference to FIG. 3 of the drawings, therein the upper part of the frame of the printer 1 is represented, indicating by dotted lines the cover 6 of the printer in the closed condition it adopts during a printing operation.

In this figure the location can likewise be seen, of said additional opening 20 in said second end of the machine. Said additional opening 20, constituted, for example, by a slotted area of the lower part of the cover of the printer, would also permit the entry of outside fresh air in the direction of arrow 14, as has already been stated, thus contributing to generation of the flow 12 of cleaning air which runs throughout the whole printing zone and which, after passing the service station 70 of the machine (arrow 15), is released in 13.

Figure 4:
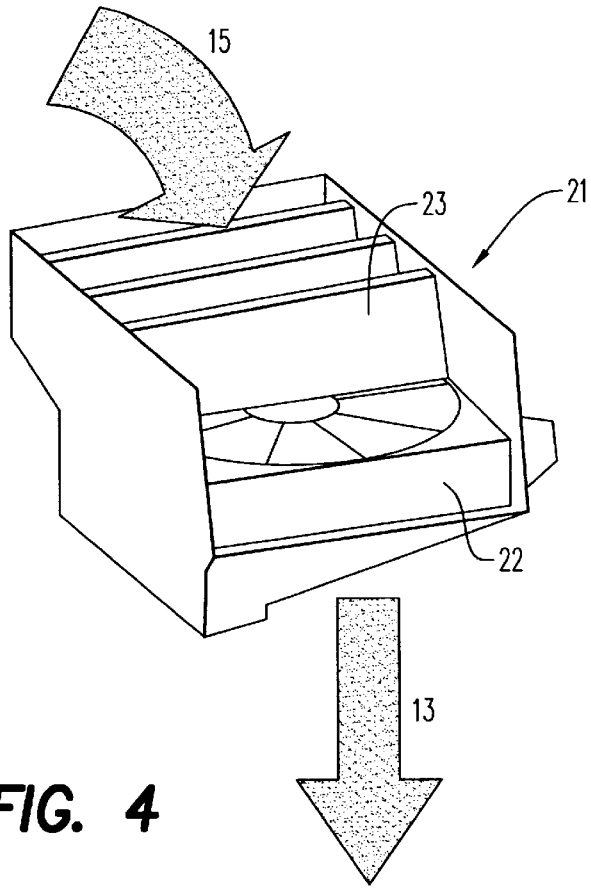
FIG. 4 is a detailed view of the suction unit, in a first embodiment of the invention.

Likewise represented, in an overall way with 21 is the unit generating the flow 12 of cleaning air constituted in this case, by way of illustration, by a suction fan 22 (see FIG. 4).

In accordance with an alternative embodiment of the invention, said suction unit 21 may be provided with an additional filter 23, situated upstream (see FIG. 4) or downstream (not shown) from the fan 22 and designed to eliminate from the air to be released in 13 the particles swept along by the flow of cleaning air generated by the said fan 22 and whose evacuation into the atmosphere may be undesirable in certain cases, for example, in order to prevent the possible toxicity of the printer's emissions or so as to reduce deposits on the walls or the floor of the area where the printer is located.

The operation of the system in accordance with the invention is the following: during a printing operation the air is sucked by said suction unit 21 through said air inlets 10, 11, 14 of the printer. This sucked air, in the form of a flow 12 traverses the entire printing zone, the housing 5 in which the service station 70 is located (in this area of the printer a certain amount of ink aerosol is also generated, for instance during a servicing operation such as to eliminate possible residues of dry ink by ejecting a number of ink droplets into a spittoon 71 of the service station 70 or when the printhead is priming ink) and finally, said air flow exits from the printer through an evacuation opening (arrow 13) provided for this purpose in the lower part of the said machine frame, on the right-hand side of the machine, blown by the suction unit 21.

The suction power generated by the fan 22 may vary depending on the operating condition of the printer.

In a first example, the suction unit 21 runs at its predetermined power while the printer is printing, in order to remove the ink aerosol. However, when the printheads move to the service station 70 for servicing, such as for wiping, spitting, priming or other servicing functions, the fan 22 is switched off.

In fact, the applicant has found that if the fan 22 is kept working at its predetermined power, the generated air flow could create a turbulence which may affect the servicing operations. For instance, when the printhead ejects droplets into the spittoon 71 available in the service station 70, the droplets trajectories could be varied by the air flow and some ink could end out of the spittoon. Again, during a priming operation, the bubble of ink lying on the surface of the printhead could be partially removed by the air flow. For the sake of clarity, the service station can be moved along the media direction, arrows 72 and 73, between a first operative position and a second resting position. In the operative position, i.e. when the printer is servicing the printheads, the service station is moved in a position closer to the suction unit 21 (arrow 72). In the resting position, the service station 70 is moved away from the suction unit 21 (arrow 73).

In a second example, the speed of the fan 22 is modulated, by varying the voltage applied to it, depending on the operating condition of the printer. For instance, full speed, i. e. full suction power, will be employed while printing, while the fan will run at a reduced speed during servicing operations, to avoid the above drawbacks, but still providing enough suction power to clean the generated ink aerosol.

Figure 5:
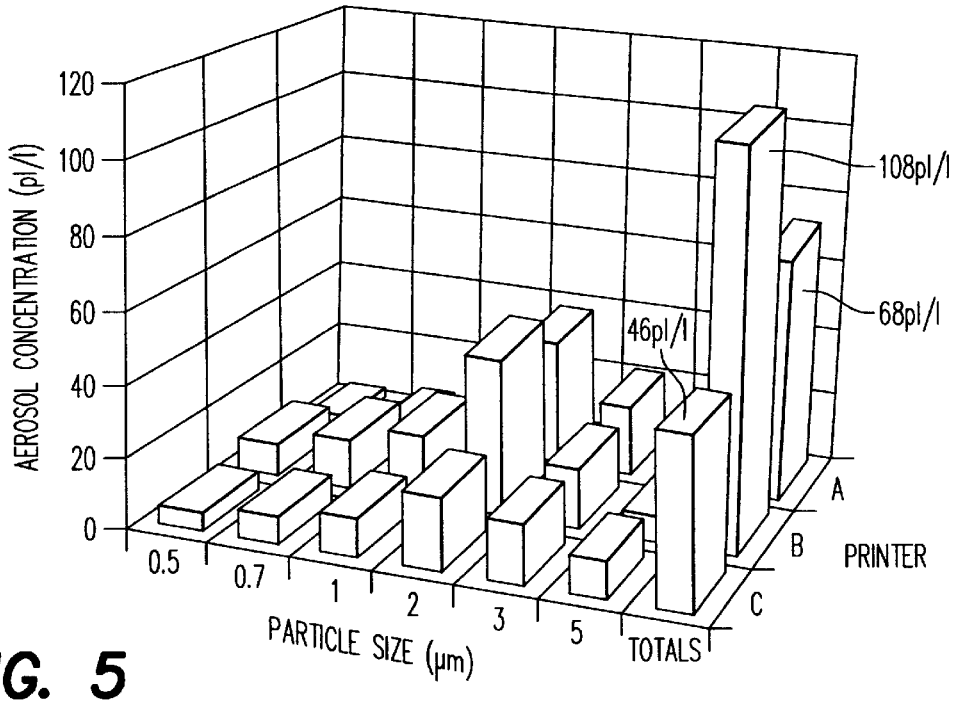
FIG. 5 is a tridimensional graph that shows the results of tests carried out on a printer according to the prior art and on a printer without and with the system according to the invention.
Figure 6:
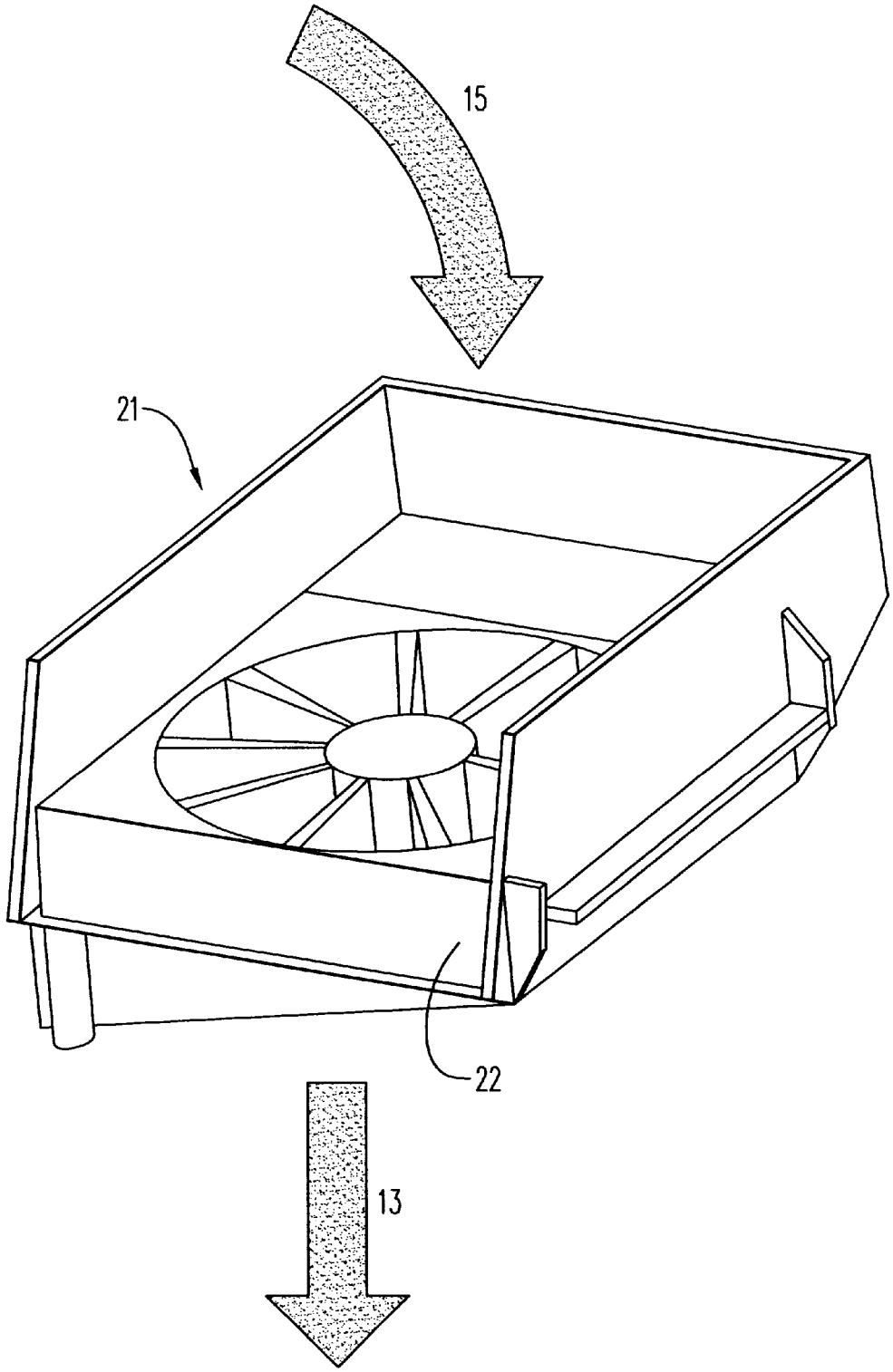
FIG. 6 is a a detailed view of the suction unit, in a second embodiment of the invention.

In a series of practical tests carried out by the applicant (see FIG. 5), the generation of ink aerosol inside the printer was measured in a prior art large format printer, a HP DesignJet 2000 CP printer mounting 4 printheads each having less than 200 nozzles and a firing frequency of 4–6 kHz, and in a higher performance, large format printer, mounting 4 printheads with 512 nozzles each and a firing frequency up to 12 kHz, of the class which the invention particularly refers to. Particularly, each printer peak levels of generated ink aerosol were considered. All the tests were carried out firing, at the maximum frequencies, simultaneously all the available printheads (black, cyan, magenta and yellow) in order to reach the peak level of ink aerosol generation. In these tests the amount of ink aerosol was measured using MetOne Model 237A Laser particle counter that sucks air, at a flow rate of 0.1 cubic feet per minute, and measures the particles (here ink particles between 0.5 and 5 microns in diameter) suspended in it for 2 minutes. The ink aerosol concentration in sucked air can be obtained knowing that the sucked volume or air for each sample is, approximately 0.5 liters and the total volume of measured particles, obtained by multiplying the number of particles of each diameter by the volume of a sphere of that diameter.

The aerosol levels in the prior art printer (See series A in FIG. 5) were measured as a benchmark. The print test consisted of obtaining the peak levels of ink aerosol printing a full blackout drawing, that made all four printheads fire at the same time. This method allowed obtaining a maximum signal to noise ratio, increasing the repeatability and reproducibility of the experiments.

The test shows that the prior art printer, including a fan installed in a service station zone that removes the air with a moderate cleaning effect, exhibited a measured level of aerosol of 68 pl/l (pico-liters of ink aerosol/liter of air).

This same test was conducted with a higher performance, large format printer having a much higher aerosol generation level than that of the printer of the prior art due to the improved performance of the printheads employed, without and with the aerosol control system in accordance with the invention.

In the first high performance printer, without the aerosol control system, the total ink aerosol generation levels measured were in the order of 108-pico liters of ink aerosol for each liter of air (see series B in FIG. 5), which gives an idea of the very high general levels of said aerosol in the case of the new printers to which the invention refers, in comparison with those of the prior art.

Lastly, in a test conducted with this same printer, but provided with a preferred embodiment of the system of the invention substantial reduction of the ink aerosol were measured.

In such a printer air flow sections were distributed in the following manner:

Printer cover zone opening: 5000 $mm^2$

This opening allows the air flow 10 to get into the body of the printer;

Rear opening: 2000 $mm^2$

This is an aperture, which runs along the whole length of the platen, placed on the rear part of the printer and substantially opposing the printer cover zone opening on the front of the printer; additionally it allows a cut sheet, once loaded in the printer, to be moved out of the back of the printer for a proper positioning before starting printing;

Additional opening 20: 10000 $mm^2$;

This aperture permit the flow 14 to get into the printer's body;

Internal air path cross section 12000 $mm^2$

This is the cross section of the air path within the printer's body, directing air flow 12 substantially from one end of the printer to the opposite end.

These values show that said additional opening 20 means a 59% of the total area of entry of air into the printer, while the total of the remaining openings comes to 41% of said total area. In other embodiments, always according to the invention, the total area of all the inlet openings may vary from 50% less to 200% more than the internal air path cross section.

Moreover, the air flow speed 12 was less than 5 m/s and preferably equal or less than 2 m/s, with the aim of avoiding misplacement of the ink droplets directed towards the paper, and was most preferably set at 1 m/s; the time to achieve an optimal renewal of the air inside the printer was approximately less than 30 sec and preferably less than 5 sec.

The skilled in the art may appreciate that the air flow speed is also dependent on the pen to paper distance for dot placement reasons. The smaller is this distance the higher can be the air flow speed. In fact, the trajectory of the ink drop from the nozzle to the media can have more substantial modification due to the air flow if the distance is bigger, so causing bigger dot misplacement. In the present case the pen to paper distance is about 1.4 mm, preferably between 1.2 mm and 1.5 mm.

The result of the measurement of the ink aerosol level in this case was only 46 pico-liters of ink aerosol per liter of air (see series C of FIG. 5), which means that, by the system of control of the ink aerosol in accordance with the invention, reduction is achieved of the concentration of said ink aerosol by 2 to 3 times in these new type printers. The above disclosure is intended as merely exemplary, and not to limit the scope of the invention—which is to be determined by reference to the appended claims.

What is claimed is:

1. An inkjet printing device comprising:

a platen on which a printing zone is defined;

a carriage, onto which at least a printhead is mounted, slidable along said printing zone near said platen;

a service station for servicing said printhead, located in a servicing zone separated from said printing zone;

a housing for protecting and enclosing said printing zone and said servicing zone; and means for producing an air flow within said housing, wherein a substantially constant air path is defined within said housing through which said air flow is allowed to pass during operation of the device, crossing both said printing zone and said servicing zone.

2. The device as claimed in claim 1, wherein said housing comprises one or more air inlets and an air outlet, said air outlet being located at a substantially first end of said housing.

3. The device as claimed in claim 2, wherein said housing comprises an additional air inlet which is located at substantially a second end of the device opposite to said first end.

4. The device as claimed in claim 3, wherein said additional inlet has a cross section that is greater than a total cross section of said one or more air inlets.

5. The device as claimed in claim 4, wherein said air flow path forces said air flow to substantially pass through an entirety of said printing zone.

6. The device as claimed in claim 2, wherein said air flow is generated by a suction means located close to said air outlet.

7. The device as claimed in claim 6, further comprising an air filter coupled to said suction means.

8. The device as claimed in claim 7, wherein said air filter is located upstream from said suction means.

9. The device as claimed in claim 6, wherein said suction means comprises a fan.

10. The device as claimed in claim 1, wherein said air flow has a flow rate that is varied depending on an operating condition of the device.

11. An inkjet printing device comprising:

a platen on which a printing zone is defined;

a carriage, onto which at least a printhead is mounted, slidable along said printing zone near said platen;

a service station for servicing said printhead, located in a servicing zone separated from said printing zone;

a housing for protecting and enclosing said printing zone and said servicing zone; and means for producing an air flow at a first flow rate within said housing, wherein an air path is defined within said housing through which said air flow is allowed to pass during operation of the device, so that when said carriage is in said servicing zone said air flow is generated at a different flow rate.

12. A method for reducing ink aerosol in a inkjet printing device, during operation of the device, said device including a housing for protecting and enclosing a printing zone and a servicing zone of the device, said method comprising the following steps:

producing an air flow within said housing; and forcing said air flow to pass through a substantially constant air path defined within said housing, crossing both said printing zone and said servicing zone.

* * * * *